US012655710B2

(12) United States Patent
Yue et al.

(10) Patent No.: US 12,655,710 B2
(45) Date of Patent: Jun. 16, 2026

(54) PACKER AND UNSEALING METHOD THEREOF

(71) Applicants: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

(72) Inventors: Hui Yue, Beijing (CN); Tong He, Beijing (CN); Wei Pang, Beijing (CN); Shidong Ding, Beijing (CN); Jun Mao, Beijing (CN); Xiao Guo, Beijing (CN)

(73) Assignees: CHINA PETROLEUM & CHEMICAL CORPORATION, Beijing (CN); SINOPEC PETROLEUM ENGINEERING TECHNOLOGY RESEARCH INSTITUTE CO., LTD., Beijing (CN)

( * ) Notice: Subject to any disclaimer, the term of this patent is extended or adjusted under 35 U.S.C. 154(b) by 0 days.

(21) Appl. No.: 18/997,065

(22) PCT Filed: Jul. 18, 2023

(86) PCT No.: PCT/CN2023/107861
§ 371 (c)(1),
(2) Date: Jan. 18, 2025

(87) PCT Pub. No.: WO2024/017231
PCT Pub. Date: Jan. 25, 2024

(65) Prior Publication Data

US 2026/0028891 A1 Jan. 29, 2026

(30) Foreign Application Priority Data

Jul. 22, 2022 (CN) ..... 202210866167.0

(51) Int. Cl.
*E21B 33/12* (2006.01)
*E21B 23/00* (2006.01)

(52) U.S. Cl.
CPC ..... *E21B 33/1208* (2013.01); *E21B 23/00* (2013.01)

(58) Field of Classification Search
CPC ..... E21B 33/1208; E21B 23/00
See application file for complete search history.

(56) References Cited

U.S. PATENT DOCUMENTS 3,659,647 A * 5/1972 Brown ..... E21B 33/128 166/134
4,438,933 A * 3/1984 Zimmerman ..... E21B 33/1285 166/134

(Continued)

FOREIGN PATENT DOCUMENTS

CN 2445095 Y 8/2001
CN 101165310 A 4/2008

(Continued)

OTHER PUBLICATIONS

English translation of PCT WO (Year: 2023).*

*Primary Examiner* — Steven A Macdonald
(74) *Attorney, Agent, or Firm* — NKL Law; Allen Xue

(57) ABSTRACT

The present invention proposes a packer, comprising a central tube (1), an outer surface of which is provided with a first prefabricated groove (11); a rubber cylinder unit (2), comprising a rubber cylinder assembly (21), an upper rubber cylinder seat (22) and a lower rubber cylinder seat (23), a slot (221) being formed in an inner wall surface of the upper rubber cylinder seat; an upper anchoring unit (3) and a lower anchoring unit (4) arranged at both ends of the rubber cylinder unit, respectively, the upper anchoring unit comprising an upper cone (31) and an upper slip (32), and the lower anchoring unit comprising a lower cone (41) and a (Continued)

lower slip (42); and an unsetting mechanism (5), comprising a connecting sleeve (51), wherein through grooves (511) are arranged on the connecting sleeve, and one unsetting block (52) is arranged in each through groove.

15 Claims, 1 Drawing Sheet

(56) References Cited

U.S. PATENT DOCUMENTS

| | | | | | |
|---|---|---|---|---|---|
| 4,457,369 | A * | 7/1984 | Henderson | E21B 33/1293 | 166/134 |
| 4,949,792 | A * | 8/1990 | Rubbo | E21B 23/006 | 166/134 |
| 5,186,258 | A * | 2/1993 | Wood | E21B 33/1243 | 166/147 |
| 5,226,494 | A * | 7/1993 | Rubbo | E21B 34/066 | 166/66.4 |
| 2018/0023368 | A1 * | 1/2018 | Anderson | E21B 33/129 | 166/134 |

FOREIGN PATENT DOCUMENTS

| | | | |
|---|---|---|---|
| CN | 203905893 | U | 10/2014 |
| CN | 204627521 | U | 9/2015 |
| CN | 105201446 | A | 12/2015 |
| CN | 205577940 | U | 9/2016 |
| CN | 108915633 | A | 11/2018 |
| CN | 111502588 | A | 8/2020 |
| CN | 215213421 | U | 12/2021 |

* cited by examiner

PACKER AND UNSEALING METHOD THEREOF

CROSS REFERENCE OF RELATED APPLICATIONS

This application is a U.S. national stage entry of PCT International Application No. PCT/CN/2023/107861, filed on Jul. 18, 2023, which claims the priority of Chinese patent application No. 202210866167.0 entitled "High-pressure packer and unsetting method thereof" and filed on Jul. 22, 2022, the content of which is incorporated herein by reference in its entirety.

TECHNICAL FIELD

The present invention relates to the technical field of petroleum and natural gas drilling and completion, and specifically to a packer and a method for unsetting the same.

TECHNICAL BACKGROUND

Downhole packers in oil and gas wells are generally divided into retrievable packers and permanent packers. In retrievable packers, the slips are installed on one side of the rubber cylinder. The slips and the cone are separated from each other usually by lifting, lowering the tool or the like, in order to retrieve the slips and thus unset the packer. However, when the retrievable packer is subjected to bidirectional alternating pressure, the slips will loosen due to poor force condition, or the hydraulic pressure will be transmitted to components such as self-locking mechanism of the packer, thus resulting in premature unsetting of the retrievable packer and affecting the pressure-bearing reliability thereof.

In permanent packers, a set of one-way slips is usually arranged on each side of the rubber cylinder. Through axial extrusion, the rubber cylinder of the permanent packer expands, while the slips on both sides can be respectively anchored on the casing. Thus when the permanent packer is subjected to alternating pressure, the load is always exerted on the casing so that the slips will not loosen. At the same time, other components of the permanent packer will not be affected, thereby significantly improving the sealing reliability. However, since the cone of the permanent packer is located between the two sets of slips and thus cannot be released, it is rather difficult to unset the packer by directly lifting the string due to the resilience of the rubber cylinder, etc. Therefore, unsetting can be achieved only by overall milling, which results in difficulties in later wellbore treatment and reduces the efficiency of later construction and operation, thus leading to limited application of such permanent packer.

SUMMARY OF THE INVENTION

In view of the above technical problems, the present invention proposes a packer which features high pressure-bearing performance, high retrievable property, reliable sealing capability and convenient operation, with a high success rate of unsetting operation.

The packer according to the present invention comprises a central tube, an outer surface of which is provided with a first prefabricated groove; a rubber cylinder unit arranged on the central tube, comprising a rubber cylinder assembly, and an upper rubber cylinder seat and a lower rubber cylinder seat arranged at both ends of the rubber cylinder assembly, respectively, a slot being formed in an inner wall surface of the upper rubber cylinder seat; an upper anchoring unit and a lower anchoring unit arranged at both ends of the rubber cylinder unit, respectively; and an unsetting mechanism, comprising a connecting sleeve arranged between the upper anchoring unit and the upper rubber cylinder seat, and an unsetting block extending through a wall of the connecting sleeve in a radial direction, wherein the unsetting block is configured to engage with the slot at a radially outer side thereof in an initial state, so that the upper rubber cylinder seat is fixed to an upper cone of the upper anchoring unit in an axial direction, and engage with the first prefabricated groove at a radially inner side thereof through a lifting movement of the central tube, in order to be disengaged from the slot, whereby the upper rubber cylinder seat is axially movable relative to the upper cone to unset the rubber cylinder unit, and a lower cone of the lower anchoring unit and the upper cone are configured to move upward and downward respectively through the lifting movement and a pressing-down movement of the central tube, thereby releasing the lower anchoring unit and the upper anchoring unit respectively.

In one embodiment, each of two outer ends of the unsetting block is provided with a chamfer, through which the unsetting block enters the first prefabricated groove under an axial force.

In one embodiment, a lock ring is arranged between the upper rubber cylinder seat and the connecting sleeve, and configured to allow the upper rubber cylinder seat to move upward relative to the connecting sleeve only.

In one embodiment, first one-way teeth are arranged on an inner surface of the lock ring, while second one-way teeth are arranged on an outer surface of the connecting sleeve, wherein the first one-way teeth are engageable with the second one-way teeth.

In one embodiment, a lock ring sleeve for installing the lock ring is fixedly connected to an upper end of the upper rubber cylinder seat.

In one embodiment, a plurality of through grooves evenly distributed along a circumferential direction is arranged on the connecting sleeve, wherein one unsetting block is arranged in each through groove.

In one embodiment, the upper anchoring unit includes an upper slip in cooperation with the upper cone which is fixedly connected to the connecting sleeve.

In one embodiment, the lower anchoring unit includes a lower slip in cooperation with the lower cone which is fixedly connected to the lower rubber cylinder seat.

In one embodiment, the unsetting mechanism further includes an unsetting ring in a position where the lower cone is connected to the lower rubber cylinder seat, and a second prefabricated groove is formed on the outer surface of the central tube, wherein the unsetting ring is configured to engage with the second prefabricated groove through the lifting movement of the central tube, in order to drive the lower cone to move upward.

In one embodiment, an installation groove is formed on an inner wall of the lower rubber cylinder seat, for receiving the unsetting ring.

In one embodiment, the lock ring and the unsetting ring are open elastic rings.

In one embodiment, the unsetting mechanism further includes an auxiliary unsetting mechanism, which comprises a first elastic member and a second elastic member, wherein the first elastic member is arranged between the upper cone and an axial end surface of an upper string connected to the central tube, and the second elastic member is arranged between the lower cone and an axial end surface of a lower driving mechanism.

In one embodiment, the upper anchoring unit and the lower anchoring unit are anchored to a wellbore casing through an axial force of a lower driving mechanism, so that the rubber cylinder unit is set.

According to a second aspect of the present invention, a method for unsetting said packer is proposed, comprising steps of:

lifting the central tube, so that the upper rubber cylinder seat moves in the axial direction relative to the upper cone through the unsetting mechanism, in order to release axial compression on the rubber cylinder unit;

further lifting the central tube, so that the central tube drives the lower cone to move upward through the unsetting mechanism, in order to release a radial support of the lower cone on the lower slip, thus releasing the lower anchoring unit; and lifting a pipe string to retrieve the packer.

In one embodiment, after the lower anchoring unit is released and before the pipe string is lifted, the central tube is pressed down to drive, through the unsetting mechanism, the upper cone to move downward, in order to release a radial support of the upper cone on the upper slip, thus releasing the upper anchoring unit.

Compared with the prior arts, the present invention has the following advantages.

The unsetting mechanism of the packer according to the present invention can reliably unset the packer comprising a centered rubber cylinder and double two-way slips, avoiding the situation where the packer cannot be unset or is prone to unsetting failure. Meanwhile, the packer has high pressure-bearing capacity and reliable sealing performance. Therefore, the packer can be particularly applied as a downhole high-pressure packer. The packer is able to achieve unsetting operation with a high success rate only through lifting and pressing down the pipe string, which dispenses with other special tools during the unsetting procedure. Moreover, the packer is not only safe and reliable, but also has a simple structure. When it is impossible to unset through lifting due to special operating conditions, the packer can be still unset through "lifting-pressing down-lifting" operations with the unsetting mechanism. In this manner, the success rate of unsetting is greatly improved, thus significantly contributing to the reliability and unsetting performance of the packer.

BRIEF DESCRIPTION OF THE DRAWINGS

The present invention will be described below with reference to the accompanying drawings.

In the present application, all accompanying drawings are schematic ones, provided to illustrate the principle of the present invention merely, and are not necessarily drawn to actual scale.

DETAILED DESCRIPTION OF EMBODIMENTS

The present invention will be described below in detail with reference to the accompanying drawings.

Figure 1:
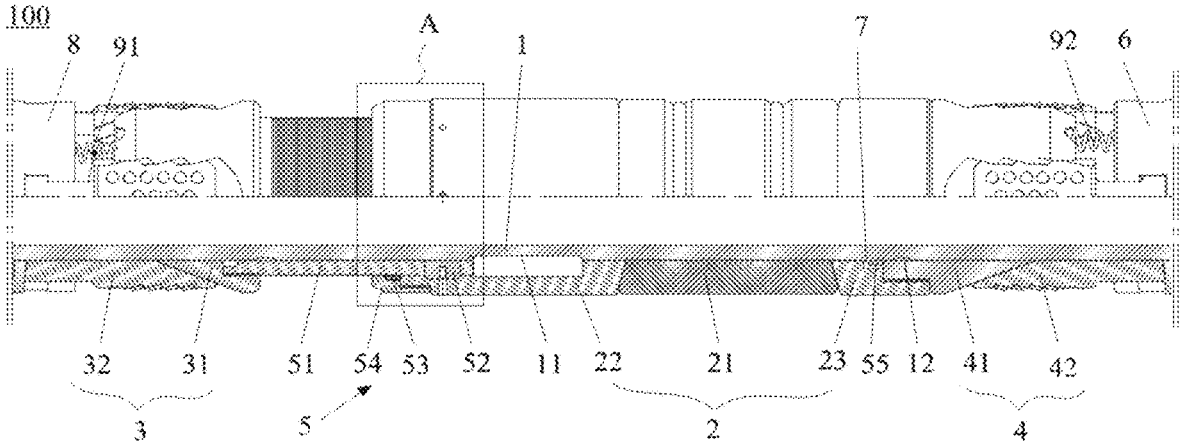
FIG. 1 schematically shows a structure of a packer according to the present invention.

For the sake of convenience, in the present application, an end proximate to the wellhead is defined as an upper end, an upstream end, or the like, such as a left end in FIG. 1, while an end away from the wellhead is defined as a lower end, a downstream end, or the like, such as a right end in FIG. 1. Further, a direction along a length of the packer is defined as "longitudinal", "axial", or the like, while a direction perpendicular thereto is defined as "lateral", "radial", or the like.

FIG. 1 schematically shows a structure of a packer 100 according to the present invention. As shown in FIG. 1, the packer 100 includes a central tube 1, a rubber cylinder unit 2, an upper anchoring unit 3 and a lower anchoring unit 4, and an unsetting mechanism 5. An upper portion of the central tube 1 is configured to connect to an upper string 8, and a lower portion thereof is configured to connect to a lower drilling tool comprising a lower driving mechanism 6, which may be, for example, a piston driving mechanism. The rubber cylinder unit 2 is sleeved on the central tube 1 and includes a rubber cylinder assembly 21, and an upper rubber cylinder seat 22 and a lower rubber cylinder seat 23 arranged at two axial ends of the rubber cylinder assembly 21, respectively. Both the upper anchoring unit 3 and the lower anchoring unit 4 are sleeved on the central tube 1 and arranged at two axial ends of the rubber cylinder unit 2, respectively. The upper anchoring unit 3 includes an upper cone 31 and an upper slip 32 in cooperation therewith, and the lower anchoring unit 4 includes a lower cone 41 and a lower slip 42 in cooperation therewith. The unsetting mechanism 5 is arranged between the upper anchoring unit 3 and the rubber cylinder unit 2 as well as the lower anchoring unit 4.

According to the present invention, the upper anchoring unit 3 and the lower anchoring unit 4 can be anchored by the lower driving mechanism 6, and the rubber cylinder unit 2 can be set also by the lower driving mechanism 6. The lower driving mechanism 6 may be, for example, a piston driving mechanism, which is driven by a pressure of drilling fluid. For example, the lower driving mechanism 6 may operate as follows. The lower driving mechanism 6 pushes the lower slip 42 to move upward along the lower cone 41, so that the lower slip 42 is pushed out along a radial direction until it abuts against a casing wall. Afterwards, the lower driving mechanism 6 pushes the lower anchoring unit 4 and the rubber cylinder unit 2 to continue to move upward, thereby pushing the upper cone 31 to move upward, so that the upper slip 32 is pushed out along the radial direction until it abuts against the casing wall. Thus, the upper anchoring unit 3 is anchored. Then, the lower driving mechanism 6 can continue to push the lower anchoring unit 4 upward and thus compress the rubber cylinder unit 2, so that the rubber cylinder assembly 21 expands along the radial direction to abut against the casing wall. Thus the rubber cylinder unit 2 is set, while the upper slip 32 and the lower slip 42 bite into the casing wall to form anchor. It should be noted that anchoring teeth of the upper slip 32 and the lower slip 42 have opposite orientations, so that the upper slip 32 can be anchored upward, while the lower slip 42 can be anchored downward. Therefore, the lower slip 42, after abutting against the casing wall, can continue to move upward driven by the lower driving mechanism 6, thereby further activating the upper anchoring unit 3 and the rubber cylinder unit 2 to achieve setting.

According to the present invention, the unsetting mechanism 5 is configured to move the upper rubber cylinder seat 22 relative to the upper cone 31 through lifting the central tube 1, thus releasing an axial compression of the rubber cylinder unit 2. Also, the central tube 1 can drive the lower cone 41 to move upward to release the lower anchoring unit 4. Further, by pressing down the central tube 1, the upper cone 31 can be driven to move downward to release the upper anchoring unit 3. Thus, the packer 100 is unset.

According to the present invention, as shown in FIG. 1, the unsetting mechanism 5 includes a connecting sleeve 51 arranged between the upper cone 31 and the upper rubber cylinder seat 22. An upper end of the connecting sleeve 51 is fixedly connected to the upper cone 31. In one embodiment, the connecting sleeve 51 and the upper cone 31 are fixedly connected to each other through threads. In an initial state, the connecting sleeve 51 enables the upper cone 31 and the upper rubber cylinder seat 22 to be axially fixed to each other, in order to transfer axial force, and enables the upper cone 31 and the upper rubber cylinder seat 22 to move relatively to each other during unsetting. It should be noted that the packer 100 is in the initial state during well entry as well as the anchoring and setting procedures.

As shown in FIG. 1, the connecting sleeve 51 has a cylindrical shape. The upper end of the connecting sleeve 51 is provided with external threads, while a lower end of the upper cone 31 is formed as an inner step with internal threads on an inner wall thereof. Through the external threads, the connecting sleeve 51 engages with the internal threads of the upper cone 31 to form a fixed connection therebetween.

Figure 2:
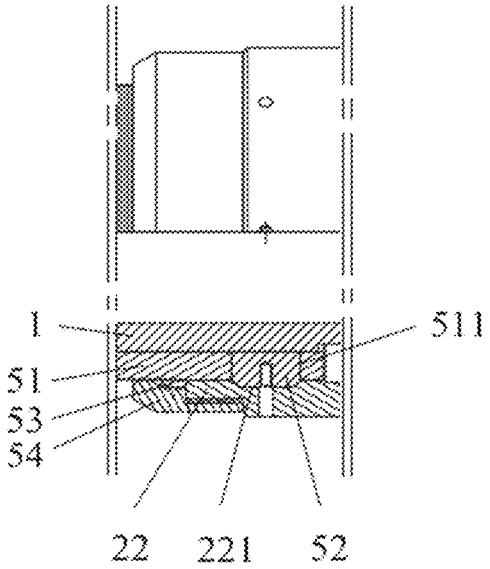
FIG. 2 is an enlargement view of Area A in FIG. 1.

According to the present invention, as shown in FIG. 2, at least one through groove 511 is arranged in the connecting sleeve 51. Preferably, the through groove 511 is arranged on a lower side wall close to the connecting sleeve 51, extending through a side wall of the connecting sleeve 51 along the radial direction. In a preferred embodiment, a plurality of through grooves 511 is provided and evenly distributed along a circumferential direction. An unsetting block 52 that can slide radially along the through groove 511 is installed in each through groove 511. An outer surface of the central tube 1 is provided with a first prefabricated groove 11, which partially extends along an axial direction and may be formed, for example, as an annular groove. Meanwhile, a slot 221 is formed in an inner wall surface of the upper rubber cylinder seat 22. In the initial state, the unsetting block 52 is axially offset from the first prefabricated groove 11 to engage with the slot 221, so that a part of the unsetting block 52 in the through groove 511 protrudes outward and is embedded in the slot 221. Thus, the connecting sleeve 51 and the upper rubber cylinder seat 22 are relatively fixed to each other along the axial direction. When the central tube 1 is lifted to a position where the first prefabricated groove 11 corresponds to the through groove 511, a radially inner end of the unsetting block 52 can enter and engage with the first prefabricated groove 11, thereby disengaging from the slot 221 at a radially outer end thereof. At this time, the connecting sleeve 51 is no longer relatively fixed to the upper rubber cylinder seat 22 along the axial direction, so that the upper rubber cylinder seat 22 is able to move relative to the upper cone 31.

In order to ensure that the unsetting block 52 does not affect a relative movement between the upper rubber cylinder seat 22 and the upper cone 31 when engaging with the first prefabricated groove 11, the unsetting block 52 is configured to have a thickness no more than a sum of a depth of the first prefabricated groove 11 and a wall thickness of the connecting sleeve 51.

According to one embodiment of the present invention, two outer ends of the unsetting block 52 are provided with chamfers, through which the unsetting block 52 can enter the first prefabricated groove 11 under the axial force. Since in a setting state the connecting sleeve 51 is subjected to the axial forces of the upper cone 31 and the upper rubber cylinder seat 22, the chamfers of the unsetting block 52 will enable the unsetting block 52 to retract inward under the axial forces when the central tube 1 moves to the position where the first prefabricated groove 11 corresponds to the through groove 511, thereby releasing the connecting sleeve 51 from the upper rubber cylinder seat 22. Meanwhile, the chamfers can further avoid the unsetting block 52 from affecting a relative movement between the connecting sleeve 51 and the upper rubber cylinder seat 22 after retracting.

Preferably, a plurality of unsetting blocks 52 can be arranged and evenly spaced apart in the circumferential direction.

As shown in FIGS. 1 and 2, a lock ring 53 is arranged at an upper end of the upper rubber cylinder seat 22, so that the upper rubber cylinder seat 22 can only move upward relative to the connecting sleeve 51. Preferably, the lock ring 53 is an open elastic lock ring. First one-way teeth, such as one-way serrated internal threads, are arranged on an inner surface of the lock ring 53, while second one-way teeth, such as one-way serrated external threads, are arranged on an outer surface of the connecting sleeve 51. The first one-way teeth of the lock ring 53 are engageable with the second one-way teeth of the connecting sleeve 51, thereby realizing movement in one direction and locking in a reverse direction between the lock ring 53 and the connecting sleeve 51. Thus, the upper rubber cylinder seat 22 can only move upward relative to the connecting sleeve 51.

As shown in FIGS. 1 and 2, a lock ring sleeve 54 for installing the lock ring 53 is fixedly connected to the upper end of the upper rubber cylinder seat 22. An inclined surface with a certain angle of inclination is arranged on an inner surface of the lock ring sleeve 54, for cooperating with the lock ring 53, so that the lock ring 53 can only move upward relative to the connecting sleeve 51. In one embodiment, the lock ring sleeve 54 is fixedly connected to the upper rubber cylinder seat 22 through threads, which facilitates the installation and disassembly of the lock ring 53.

As shown in FIG. 2, the upper rubber cylinder seat 22 is provided with a through hole, while the unsetting block 52 is provided with an auxiliary installation hole for facilitating an installation thereof, in order to ensure that the unsetting block 52 is aligned with the slot 221 of the upper rubber cylinder seat 22. Specifically, when the unsetting block 52 is installed, the unsetting block 52 is placed into the through groove 511 of the connecting sleeve 51 first and aligned with the first prefabricated groove 11, so that the unsetting block 52 is in a retracted state along the radial direction. Then, the upper rubber cylinder seat 22 is sleeved on the connecting sleeve 51, with the through hole of the upper rubber cylinder seat 22 being aligned with the auxiliary installation hole of the unsetting block 52. Further, an auxiliary installation screw is inserted in the auxiliary installation hole and the through hole, thereby fixing the unsetting block 52 relative to the upper rubber cylinder seat 22. Then the connecting sleeve 51 is pushed upward, until the unsetting block 52 is pushed out of the first prefabricated groove 11 and protrudes outward along the radial direction to be locked in the slot 221 corresponding to the upper rubber cylinder seat. After the packer 100 is assembled, the auxiliary installation screw is removed, thereby completing the installation of the unsetting block 52. In order to ensure that the unsetting block 52 can be pushed out of the first prefabricated groove 11, both upper and lower end side walls of the first prefabricated groove 11 are formed as conical surfaces.

Preferably, the rubber cylinder assembly 21 consists of multiple rubber cylinders. For example, in the embodiment as shown in FIG. 1, the rubber cylinder assembly 21 comprises three rubber cylinders. The upper rubber cylinder seat 22 and the lower rubber cylinder seat 23 are arranged at upper and lower ends of the rubber cylinder assembly 21, respectively. As an important component of the unsetting mechanism 5, the upper rubber cylinder seat 22 can not only provide axial compression and supporting force for the setting of the rubber cylinder assembly 21, but also cooperates with the lock ring 53, the unsetting block 52 and the central tube 1, thereby realizing the main function of the unsetting mechanism 5.

As shown in FIG. 1, each of an upper end surface of the upper rubber cylinder seat 22 and a lower end surface of the lower rubber cylinder seat 23 is formed as a conical surface facing outward, so as to facilitate radial expansion of the rubber cylinder assembly 21 when the upper rubber cylinder seat 22 and the lower rubber cylinder seat 23 axially compress the rubber cylinder assembly 21, which is conducive to the setting of the packer.

According to the present invention, the lower cone 41 is fixedly connected to the lower rubber cylinder seat 23. As shown in FIG. 1, the lower cone 41 is fixedly connected to the lower rubber cylinder seat 23 through a stepped threaded connection buckle. Thus, the lower cone 41 is integrally connected to the lower rubber cylinder seat 23.

According to the present invention, the unsetting mechanism 5 also includes an unsetting ring 55. A second prefabricated groove 12 is formed in the outer surface of the central tube 1 at a position downstream of the first prefabricated groove 11. The unsetting ring 55 is initially sleeved on the central tube 1 and at a position upstream of the second prefabricated groove 12. The unsetting ring 55 can engage with the second prefabricated groove 12 when the central tube 1 is lifted, in order to drive the lower cone 41 to move upward.

As shown in FIG. 1, an installation groove 7 is formed in an inner wall of the lower cone 41, for receiving the unsetting ring 55. The installation groove 7 is an annular groove. The unsetting ring 55 is preferably an open elastic lock ring made of spring steel and installed in the installation groove 7. When the central tube 1 moves relative to the unsetting ring 55 until the second prefabricated groove 12 corresponds to the installation groove 7, the unsetting ring 55 can be snapped in the corresponding second prefabricated groove 12 under the elastic force. The unsetting ring 55 and the second prefabricated groove 12 are of one-direction design. Therefore, after the unsetting ring 55 is snapped in the second prefabricated groove 12, a radially inner end thereof engages with the second prefabricated groove 12, while a radially outer end thereof still corresponds to the installation groove 7. Thus, the central tube 1 can drive the lower cone 41 to move upward, so that the lower slip 42 retracts due to lack of radial support, thereby releasing the lower anchoring unit 4.

In one embodiment, the installation groove 7 is formed at a portion connecting the lower rubber cylinder seat 23 with the lower cone 41. An inner step with an end surface facing downward is arranged on an inner wall of the lower rubber cylinder seat 23, and the installation groove 7 is formed between the end surface of the inner step and an upper end surface of the lower cone 41.

According to the present invention, the unsetting mechanism 5 further includes an auxiliary unsetting mechanism. As shown in FIG. 1, the auxiliary unsetting mechanism includes a first elastic member 91 and a second elastic member 92. The first elastic member 91 is arranged between the upper cone 31 and an axial end surface of the upper string 8 connected to the central tube 1, and the second elastic member 92 is arranged between the lower cone 41 and an axial end surface of a piston connection seat of the lower driving mechanism 6. When the packer 100 is set, the first elastic member 91 and the second elastic member 92 are each in a compressed state. When the upper anchoring unit 3 and the lower anchoring unit 4 are to be released, the auxiliary unsetting mechanism can separate the upper cone 31 and the upper slip 32 as well as the lower cone 41 and the lower slip 42 from each other under axial forces of the first elastic member 91 and the second elastic member 92, so as to assist in releasing the upper anchoring unit 3 and the lower anchoring unit 4 and thus unsetting the packer 100.

According to the present invention, a method for unsetting the above-mentioned packer is also proposed, which is described in detail as follows.

In practice, the packer 100 according to the present invention is connected to the string through the central tube 1, and then lowered to a predetermined position in the wellbore.

When the packer 100 is to be set, it is driven by the lower driving mechanism 6 to axially push the piston connection seat upward, thereby pushing the lower cone 41 and the upper cone 31 to move close to each other along the axial direction. Then, the lower anchoring unit 4 and the upper anchoring unit 3 bite into the casing wall through the lower slip 42 and the upper slip 32, respectively, in order to anchor to the wellbore casing, thereby achieving the anchoring of the packer 100. Moreover, the lower cone 41 transmits the axial force through the lower rubber cylinder seat 23, while the upper cone 31 transmits the axial force through the connecting sleeve 51 and the upper rubber cylinder seat 22, thereby axially compressing the rubber cylinder unit 2 to expand in the radial direction until abutting against the casing wall. In this manner, the setting is completed.

When the packer 100 needs to be unset, the central tube 1 is lifted first. As the central tube 1 moves upward, i.e., axially relative to the connecting sleeve 51 until the first prefabricated groove 11 corresponds to the through groove 511, the unsetting block 52 automatically retracts due to the chamfer structure under the axial force, so that the radially inner end of the unsetting block 52 enters and engages with the first prefabricated groove 11, thus disengaging from the slot 221. At this time, the upper rubber cylinder seat 22 can axially move upward relative to the upper cone 31. With the cooperation between the first one-way teeth of the lock ring 53 and the second one-way teeth of the connecting sleeve 51, the upper rubber cylinder seat 22 can only move upward relative to the connecting sleeve 51. At the same time, the upper cone 31 is no longer subject to the supporting forces of the upper rubber cylinder seat 22 and the lower rubber cylinder seat 23.

Afterwards, the pipe string is further lifted. When the central tube 1 moves relative to the unsetting ring 55 until the second prefabricated groove 12 corresponds to the installation groove 7, the unsetting ring 55 is snapped in the second prefabricated groove 12 under the elastic force. In this manner, the central tube 1 can drive the lower cone 41 to move upward, so that the lower slip 42 retracts due to lack of radial support, thereby releasing the lower anchoring unit 4.

Then the central tube 1 continues to be lifted. At this time, since the upper cone 31 still supports the upper slip 32, the lifting load will be relatively large. Therefore, after a predetermined level of lifting, which can be determined according to the pipe string and well conditions, it is necessary to press down the pipe string. When the pipe string is pressed down, the unsetting block 52 can drive the upper cone 31 to move downward through the connecting sleeve 51 as the central tube 1 moves downward, so that the upper slip 32 retracts due to lack of radial support, thereby releasing the upper anchoring unit 3.

After the lower anchoring unit 4 and the upper anchoring unit 3 are both released, the pipe string continues to be lifted, thereby realizing the retrieval of the entire packer 100.

In practice, after internal forces between the rubber cylinder unit, the upper slip 32, and the lower slip 42 are released by lifting the pipe string, it will be theoretically easy to continue lifting for unsetting. However, when it is impossible to unset the packer through lifting due to special operating conditions, the unsetting mechanism 5 arranged between the rubber cylinder unit 2 and the upper anchoring unit 3 and the lower anchoring unit 4 can further provide an alternate unsetting mode by pressing down the pipe string. Specifically, the pipe string is pressed down to drive the unsetting block 52, the connecting sleeve 51, and the upper cone 31 to move downward. After the upper slip 32 is released, the lifting operation is resumed, in which case it will be apparently easier to unset. Therefore, the packer 100 according to the present invention can be unset through two modes, namely "direct lifting" mode and "lifting-pressing down-lifting" mode. In this manner, the success rate of unsetting the packer 100 is improved, thus significantly enhancing the reliability and unsetting performance of the packer 100.

The packer 100 according to the present invention can achieve effective setting through the rubber cylinder unit 2, while maintaining structural stability through the upper anchoring unit 3 and the lower anchoring unit 4 and achieving effective transmission of axial force. During unsetting, the upper anchoring unit 3 and the lower anchoring unit 4 can be released by lifting and pressing down the pipe string, so as to release the internal force of the rubber cylinder assembly 21, thereby allowing the rubber cylinder assembly 21 to restore and unset, and releasing the internal force between the upper cone 31 and the upper slip 32 as well as the lower cone 41 and the lower slip 42. In this case, the upper cone 31 and the lower cone 41 are allowed to move, so that the upper slip 32 and the lower slip 42 can retract, thereby releasing the upper anchoring unit 3 and the lower anchoring unit 4. Therefore, the lower cone 41 can be lifted while the upper cone 31 can be pressed down by lifting and pressing down the pipe string respectively, in order to unset the packer 100 successfully.

With the unsetting mechanism 5 of the packer 100, the packer comprising a centered rubber cylinder and double two-way slips can be reliably unset, avoiding the situation where such packer cannot be unset or is prone to unsetting failure. Meanwhile, the packer 100 has high pressure-bearing capacity and reliable sealing performance. Therefore, the packer 100 can be particularly applied as a downhole high-pressure packer. The packer 100 is able to achieve unsetting operation with a high success rate only through lifting and pressing down the pipe string, which dispenses with other special tools during the unsetting procedure. Moreover, the packer 100 is not only safe and reliable, but also has a simple structure. Furthermore, the packer 100 features high pressure-bearing performance in combination with high retrievable performance, so that the packer comprising the centered rubber cylinder and double two-way slips has a wider and more flexible scope of application, which can be suitable to downhole high-temperature and high-pressure environment where the pipe string is required to be retrievable.

It should be understood that in the present invention, the terms "first" and "second" are used for illustrative purposes only, and are not intended to indicate or imply relative importance or implicitly specify the number of technical features indicated. Thus, the technical features defined with the terms "first" or "second" may explicitly or implicitly include one or more such technical features. In the description of the present invention, "a plurality of" means two or more, unless otherwise specified.

The phrases "an embodiment", "some embodiments", "example", "specific example" or "some examples" as mentioned in the description mean that the particular features, structures, materials or characteristics described in conjunction with the embodiment or example are included in at least one embodiment or example of the present invention. Thus, the above illustrative phrases described throughout the description do not necessarily refer to the same embodiment or example. Moreover, the particular features, structures, materials, or characteristics described herein may be combined in any one or more of the embodiments or examples in a suitable manner.

Finally, it should be noted that the foregoing description is merely illustrative of preferred embodiments of the present invention, and is not intended to restrict the present invention. Although the present invention is described in detail with reference to the above embodiments, it is still possible for one skilled in the art to modify the technical solutions defined in the above embodiments or to replace some of the technical features with equivalent ones. Any modifications, equivalent substitutions, improvements, and the like falling within the spirit and principles of the present invention are intended to be included within the scope of protection of the present invention.

The invention claimed is:

1. A packer, comprising:

a central tube (1), an outer surface of which is provided with a first prefabricated groove (11);

a rubber cylinder unit (2) arranged on the central tube (1), comprising a rubber cylinder assembly (21), and an upper rubber cylinder seat (22) and a lower rubber cylinder seat (23) arranged at both ends of the rubber cylinder assembly (21), respectively, a slot (221) being formed in an inner wall surface of the upper rubber cylinder seat (22);

an upper anchoring unit (3) and a lower anchoring unit (4) arranged at both ends of the rubber cylinder unit (2), respectively; and an unsetting mechanism (5), comprising a connecting sleeve (51) arranged between the upper anchoring unit (3) and the upper rubber cylinder seat (22), and an unsetting block (52) extending through a wall of the connecting sleeve (51) in a radial direction, wherein the unsetting block (52) is configured to engage with the slot (221) at a radially outer side thereof in an initial state, so that the upper rubber cylinder seat (22) is fixed to an upper cone (31) of the upper anchoring unit (3) in an axial direction, and engage with the first prefabricated groove (11) at a radially inner side thereof through a lifting movement of the central tube (1), in order to be disengaged from the slot (221), whereby the upper rubber cylinder seat (22) is axially movable relative to the upper cone (31) to unset the rubber cylinder unit (2), and a lower cone (41) of the lower anchoring unit (4) and the upper cone (31) are configured to move upward and downward respectively through the lifting movement and a pressing-down movement of the central tube (1), thereby releasing the lower anchoring unit (4) and the upper anchoring unit (3) respectively.

2. The packer according to claim 1, characterized in that each of two outer ends of the unsetting block (52) is provided with a chamfer, through which the unsetting block (52) enters the first prefabricated groove (11) under an axial force.

3. The packer according to claim 1, characterized in that a lock ring (53) is arranged between the upper rubber cylinder seat (22) and the connecting sleeve (51), and configured to allow the upper rubber cylinder seat (22) to move upward relative to the connecting sleeve (51) only.

4. The packer according to claim 3, characterized in that first one-way teeth are arranged on an inner surface of the lock ring (53), while second one-way teeth are arranged on an outer surface of the connecting sleeve (51), wherein the first one-way teeth are engageable with the second one-way teeth.

5. The packer according to claim 3, characterized in that a lock ring sleeve (54) for installing the lock ring (53) is fixedly connected to an upper end of the upper rubber cylinder seat (22).

6. The packer according to claim 1, characterized in that a plurality of through grooves (511) evenly distributed along a circumferential direction is arranged on the connecting sleeve (51), wherein one unsetting block (52) is arranged in each through groove (511).

7. The packer according to claim 3, characterized in that the upper anchoring unit (3) includes an upper slip (32) in cooperation with the upper cone (31) which is fixedly connected to the connecting sleeve (51).

8. The packer according to claim 3, characterized in that the lower anchoring unit (4) includes a lower slip (42) in cooperation with the lower cone (41) which is fixedly connected to the lower rubber cylinder seat (23).

9. The packer according to claim 8, characterized in that the unsetting mechanism (5) further includes an unsetting ring (55) in a position where the lower cone (41) is connected to the lower rubber cylinder seat (23), and a second prefabricated groove (12) is formed on the outer surface of the central tube (1), wherein the unsetting ring (55) is configured to engage with the second prefabricated groove (12) through the lifting movement of the central tube (1), in order to drive the lower cone (41) to move upward.

10. The packer according to claim 9, characterized in that an installation groove (7) is formed on an inner wall of the lower rubber cylinder seat (23), for receiving the unsetting ring (55).

11. The packer according to claim 9, characterized in that the lock ring (53) and the unsetting ring (55) are open elastic rings.

12. The packer according to claim 1, characterized in that the unsetting mechanism (5) further includes an auxiliary unsetting mechanism, which comprises a first elastic member (91) and a second elastic member (92), wherein the first elastic member (91) is arranged between the upper cone (31) and an axial end surface of an upper string (8) connected to the central tube (1), and the second elastic member (92) is arranged between the lower cone (41) and an axial end surface of a lower driving mechanism (6).

13. The packer according to claim 1, characterized in that the upper anchoring unit (3) and the lower anchoring unit (4) are configured to be anchored to a wellbore casing through an axial force of a lower driving mechanism (6), so that the rubber cylinder unit (2) is set.

14. A method for unsetting the packer according to claim 1, comprising steps of:

lifting the central tube (1), so that the upper rubber cylinder seat (22) moves in the axial direction relative to the upper cone (31) through the unsetting mechanism (5), in order to release axial compression on the rubber cylinder unit (2);

further lifting the central tube (1), so that the central tube (1) drives the lower cone (41) to move upward through the unsetting mechanism (5), in order to release a radial support of the lower cone (41) on the lower slip (42), thus releasing the lower anchoring unit (4); and lifting a pipe string to retrieve the packer.

15. The method for unsetting the packer according to claim 14, characterized in that after the lower anchoring unit (4) is released and before the pipe string is lifted, the central tube (1) is pressed down to drive, through the unsetting mechanism (5), the upper cone (31) to move downward, in order to release a radial support of the upper cone (31) on the upper slip (32), thus releasing the upper anchoring unit (3).

* * * * *